US006655869B1

(12) United States Patent
Deeb et al.

(10) Patent No.: US 6,655,869 B1
(45) Date of Patent: Dec. 2, 2003

(54) DEVICE FOR INSERTING DOWELS INTO FRESHLY LAID ROAD SURFACES

(75) Inventors: Mahmoud Deeb, Unkel-Scheuren (DE); Martin Lenz, Dernbach (DE); Axel Mahlberg, Siegburg (DE); Raymond Smolders, Herentals (BE); Holger Thieme, Linz/Rhein (DE)

(73) Assignee: Wirtgen GmbH, Windhagen (DE)

( * ) Notice: Subject to any disclaimer, the term of this patent is extended or adjusted under 35 U.S.C. 154(b) by 0 days.

(21) Appl. No.: 09/890,817

(22) PCT Filed: Dec. 17, 1999

(86) PCT No.: PCT/EP99/09127

§ 371 (c)(1),
(2), (4) Date: Dec. 31, 2001

(87) PCT Pub. No.: WO00/46449

PCT Pub. Date: Aug. 10, 2000

(30) Foreign Application Priority Data

Feb. 5, 1999 (DE) ..... 199 04 797

(51) Int. Cl.[7] ..... E01C 23/04
(52) U.S. Cl. ..... 404/88; 404/100
(58) Field of Search ..... 404/100, 88

(56) References Cited

U.S. PATENT DOCUMENTS 3,443,495 A * 5/1969 Heltzel ..... 404/100
4,798,495 A * 1/1989 Laeuppi et al. ..... 404/100
4,799,820 A * 1/1989 Laeuppi et al. ..... 404/100
4,995,758 A * 2/1991 Smith ..... 404/88
5,190,397 A * 3/1993 Bengford et al. ..... 404/88
5,209,602 A * 5/1993 Godbersen ..... 404/88
5,273,374 A * 12/1993 Thoma et al. ..... 404/88
5,405,212 A * 4/1995 Swisher et al. ..... 404/74
5,941,659 A * 8/1999 Godbersen ..... 404/88
6,099,204 A * 8/2000 Godbersen ..... 404/88
6,176,643 B1 * 1/2001 Guntert et al. ..... 404/88
6,390,726 B1 * 5/2002 Guntert et al. ..... 404/88
6,390,727 B1 * 5/2002 Guntert et al. ..... 404/88
6,390,728 B1 * 5/2002 Casters ..... 404/100

FOREIGN PATENT DOCUMENTS

DE 3907643 A1 * 10/1990 ..... E01C/23/04
EP 0 196 698 A1 3/1986
EP 0 518 535 A1 6/1992

* cited by examiner

*Primary Examiner*—Gary S. Hartmann
*Assistant Examiner*—Kristine Florio
(74) *Attorney, Agent, or Firm*—Diller, Ramik & Wight

(57) ABSTRACT

In a device for inserting dowels (2) in the vicinity of transverse expansion joints of freshly laid concrete road surfaces (4), comprising a machine frame (8) supported by traveling mechanisms (6), at least one storage container (10,12) for the dowels (2), a smoothing board (20) resting on the road surface (4) and including slits (24) running in a direction of travel and provided for accommodating the dowels (2), a retaining device (28) for the dowels on the slots (24), and a dowel placing device (32), it is provided that a line conveyor device (40) accepts separated dowels (2) in a section (44) of a bottom or lateral area (48,52) of the storage container (10,12) and delivers the dowels (2) to the slots in the smoothing board (20).

35 Claims, 10 Drawing Sheets

DEVICE FOR INSERTING DOWELS INTO FRESHLY LAID ROAD SURFACES

BACKGROUND OF THE INVENTION

The invention relates to a device for inserting dowels in the area of transverse expansion joints of newly laid road surfaces.

Such devices are required for producing concrete-paved road surfaces and are frequently integrated in a slip-form paver. With the aid of slip-form pavers concrete surfaces, in particular traffic roads, are produced with continuous advance. Trucks pour fresh concrete from or with the aid of special charging devices in front of the slip-form paver. By means of distributing screws or a distributing knife the concrete is spread evenly transverse to the traveling direction. Thereafter, the concrete is compacted using shaker means and shaped with a finishing board to take the desired monolithic profile.

With the aid of a dowel placing device a plurality of dowels arranged side by side and parallel to the traveling direction at predetermined distances are placed into the still unset concrete. When the concrete has set to a certain degree, an expansion joint is produced in the concrete in the dowel area such that the road surface breaks at these places when the concrete further hardens. In this way individual separate concrete plates are produced which are connected with each other by the pressed-in dowels. This allows longitudinal expansion and fixes the level of the concrete plates.

For automated insertion of the dowels it is necessary to transport a sufficient quantity of dowels to a storage container. The dowels have to be individually transported to retainers located immediately above the road surface of fresh concrete, and the dowels from said retainers can be pressed by means of dowel placing means into the concrete down to a predetermined depth.

A known device of the generic type is described in EP 0 196 698 A1. The device for inserting dowels described therein is integrated in a slip-form paver. The dowels are located in a floorless car loader movable transversely to the traveling direction, wherein the dowels can fall from the car loader, which is open towards the bottom, into recesses of a base plate serving as smoothing board. The car loader is moved over the overall working width of the machine, until dowels are inserted into all recesses. Thereafter, the car loader returns to its initial position. When all recesses are provided with dowels, the recesses are displaced such that the dowels can fall via slots in the base plate onto the fresh concrete and can then be shaken into the concrete using two forks each.

It is a disadvantage of the known device that the car loader has only a small acceptance capacity for dowels, in particular for reasons of weight, such that a person refilling the car loader must be permanently available. Another disadvantage is that the car loader must be moved beyond the working width of the machine such that an additional free space must be kept clear beside the roadway.

From U.S. Pat. No. 5,318,377 a device for inserting dowels is known where a larger quantity of dowels are stored in two magazines from which the dowels are individually fed to a chain conveyor. The chain conveyor transports the dowels to recesses in the base plate with several dowels being temporarily stored in each recess. Then the dowels are separated again and thrown by the separation device onto the fresh concrete. It is a disadvantage of the known device that the dowels have to be alignedly placed into the magazine, which results in excessive setting-up times. Further, the configuration requiring the dowels to be separated twice is too time-consuming and thus susceptible to failure.

From EP 0 518 535 A1 a device for inserting dowels is described wherein the dowels are first laid onto a place of deposit from where they are fed to a slot comprising retaining elements. A dowel placing means then presses the dowels from the retainer into the slots and into the fresh concrete.

SUMMARY OF THE INVENTION

It is an object of the invention to further improve a device of the aforementioned type such that a large quantity of dowels can be automatically deposited without interruption of work by means of a simple construction.

The invention advantageously provides that a line conveyor device accepts separated dowels from a section of a bottom or lateral area of the storage container and feeds the dowels to the slots in the smoothing board.

The invention allows use of a large-volume storage container which can be quickly loaded in a simple manner. The large storage container allows for operation without interruption of work. The simple loading of the container reduces the setting-up times and the requirement of personnel. The device according to the invention operates fully automatically, wherein only a single transporting means consisting of the line conveyor device is needed between the storage container and the smooting board. This helps to keep the construction very simple which results in a reduced susceptibilty to failure.

Preferably, the line conveyor device comprises at least two conveyor chains extending in parallel and at a distance to each other. In this way the dowels are transported at at least two places.

The line conveyor device comprises endless elements.

A chain conveyor device comprising at least one endless chain runs synchronously and in parallel to the line conveyor device in the same traveling direction and promotes the acceptance of separated dowels by the line conveyor device.

The chain of the chain conveyor device preferably runs between the conveyor chains of the line conveyor device.

On both sides of the machine frame one dowels storage container each may be arranged, wherein the traveling direction of the line conveyor device is reversible. Since the chains can run in both directions, reversing operation is also possible during which dowels are optionally taken from either of the two storage containers. This is advantageous in particular in the case of multi-lane road surfaces since in such cases the machine can be loaded from one side only.

The bottom area and/or lateral area of the at least one storage container extend at an inclination to the raod surface. In this way the dowels can descend to the lowermost point of the storage container by gravity alone when the dowels are continuously taken from the storage container.

The chain links of the conveyor chain of the line conveyor device and the chain conveyor device consist of undercut link elements between which pockets for accepting one dowel each are formed. Said pockets are dimensioned such that they can accept dowels of different diameters. Due to the fact that undercut link elements are provided the conveyor chains can reliably retain the dowels even in vertical positions without any additional guides being necessary.

The line conveyor device can be provided with a counting device counting the number of dowels accepted by the line conveyor device and transmits a counting signal to a control device for the line conveyor device. As soon as the control device detects that a sufficient quantity of dowels for the slots in the smoothing board have been accepted, the control device can stop further acceptance of dowels. For this purpose a release device is provided at the line conveyor device, which presses the dowels from the conveyor chains back into the storage container in reaction to a signal from the control device thus disengaging the dowels from the line conveyor device and the chain conveyor device. In this way it is ensured that the line conveyor device always accepts the required quantity of dowels such that the line conveyor device can continuously circulate.

The release device preferably comprises two release plates displaceable in parallel, which press the dowels out of the acceptance area in the bottom and lateral areas.

Alternatively, the release device can comprise release plates hinged to the storage container. This offers the advantage that the actuation mechanism for the release plates can be of simple configuration.

Further, the line conveyor device may comprise a means for removing excessive dowels and replacing missing dowels. Said means ensures that the line conveyor device can run continuously.

The bottom wall of the at least one storage container can be supported on elastic buffer elements and comprise a vibration device which is designed to facilitate descending of the dowels inside the storage container and sorting them into the separation means.

The retaining device for the dowels is preferably arranged in the slots, wherein the dowels are released from the retaining device when pressure is exerted by the dowel placing device.

The width of the slots in the smoothing board can be adapted to different dowel diameters, wherein the vertical position of the retaining devices is also adjustable when the slot width is varied. This ensures that the dowels cannot protrude towards the top from the slots and cannot collide with the line conveyor device.

The retaining devices in the slots can comprise pivotable spring elements. Said spring elements release the dowels at a force exerted by the dowel placing device, which considerably exceeds the force exerted by the weight of the dowels such that the dowels can fall onto the road surface and can be immediately pressed by the dowel placing device into the road surface.

With the aid of a control cam provided at the slot and a control face provided at the retaining device the retaining devices are preferably automatically adjustable in their vertical position in dependence on the slot width. This offers the advantage that together with adjustment of the slot width the height of the retaining device is adjusted, too.

The working width of the line conveyor device and the length of the slots in the smoothing board are adjustable such that they are adaptable to dowels of different lengths. In this way the machine is not only capable of processing dowels of different diameters but also dowels of different lengths.

On the slots guiding elements adjustable in the traveling direction are arranged for horizontal and vertical guidance of the line conveyor device. Said guiding elements are adjustably arranged at the smoothing board for the purpose of adaptation to the dowel length.

The smoothing board is designed such that the mutual distance between the slots transversely to the traveling direction can also be adjusted.

The conveyor chains of the line conveyor device preferably consist of twin chains so that both ends of the dowels are guided by two conveyor chains, respectively.

It is provided that the twin chains guide the dowels at the side by the inner surface of the outer part of the twin chains, the outer part of the twin chains traveling on the guides and the inner part of the twin chains transporting the dowels.

The line conveyor device operates linearly from bottom to top along the bottom or side portions of the storage container.

The following is a detailed description of an embodiment of the present invention with reference to the accompanying drawings.

DESCRIPTION OF THE PREFERRED EMBODIMENTS

Figure 1:
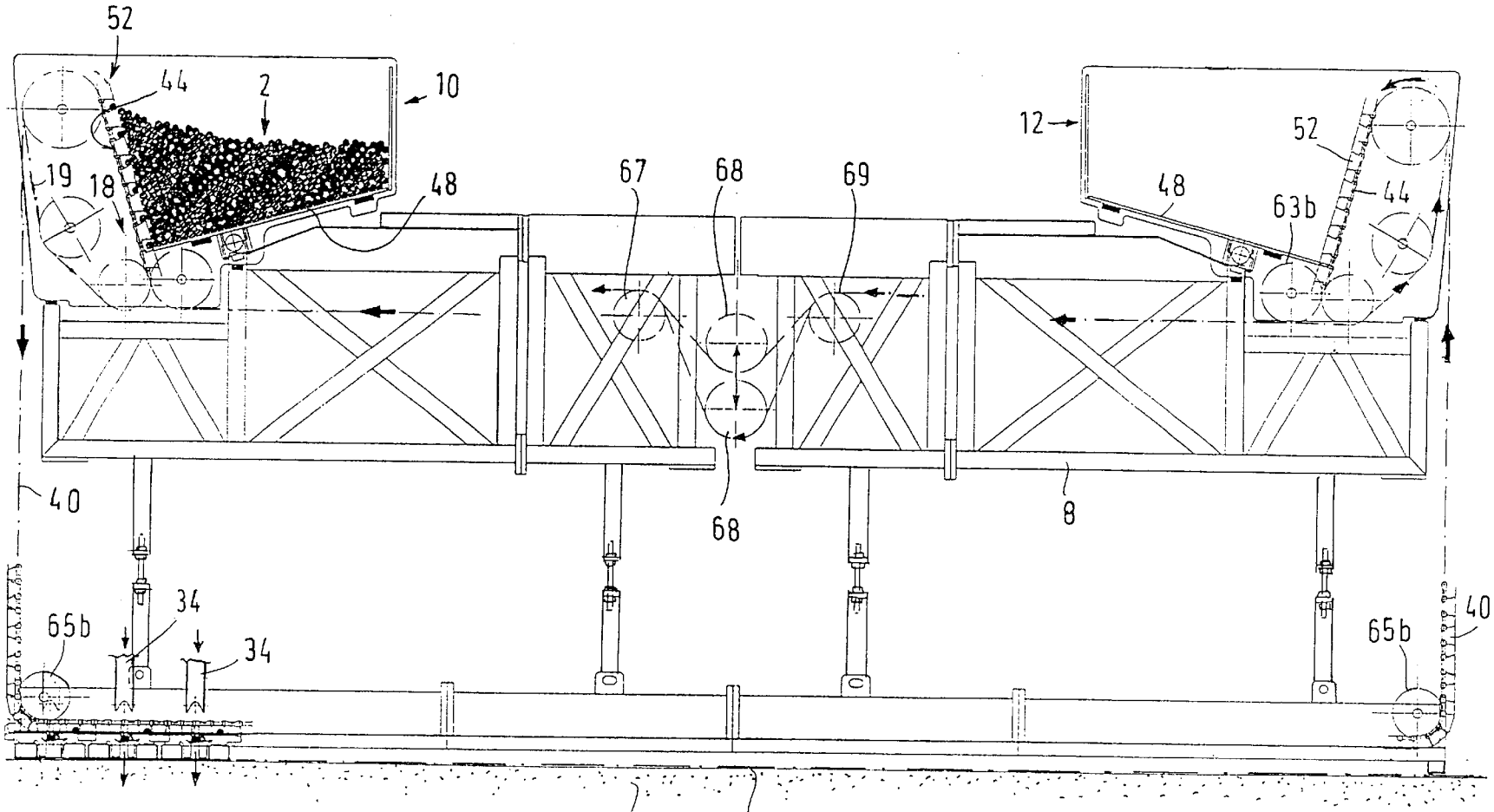
FIG. 1 is a fragmentary front view of the device according to the present invention.

FIG. 1 illustrates a device for placing dowels 2 that may be integrated in a slip-form paver or may be designed as a self-contained machine with traveling devices 6 of its own.

The device extends over the entire width of a machine frame 8 supported by traveling devices 6.

A smoothing board 20 contacts the freshly laid road surface 4 and comprises slots 24 extending in the traveling direction and parallel to each other, the slots being adapted to each receive a dowel 2 using a retaining means 28. Two forks 34, arranged successively in the traveling direction, of the dowel placing device 32 push the dowels 2 from the slots 34 into the road surface 4 for the desired depth. A vibratory means 36 transmits vibrations onto the forks 34 to facilitate pressing the dowels 2 into the road surface 4.

For the sakes of simplicity of the drawing, FIG. 1 only illustrates two adjacent forks 34 of the dowel placing means 32.

In the lateral portion of the machine frame 8, a storage container 10, 12 is provided, respectively, which can both be filled with a plurality of dowels from the side of the machine. Optionally, dowels 2 may be taken from the one or the other storage container 10, 12. To do so, one merely has to reverse the running direction of a line conveyor device 40. The storage container has a bottom wall 48 inclined in the direction of the line conveyor device 40 and a side portion 52 extending at right angles to the bottom wall 48 and parallel to a section of the line conveyor means 40, thus forming a transfer area for dowels 2. It is understood that the line conveyor device 40 may also be guided along a portion of the bottom to receive dowels.

As illustrated in FIG. 1, the line conveyor device 40 runs continuously in the direction of the arrows, with dowels 2 being received in the side portion 52 of the storage container 10 and transported to the smoothing board 20. The line conveyor device 40 passes the dowels transversely across the slots 24 in the smoothing board 20, which extend longitudinal with respect to the traveling direction, the dowels 2 first falling on the retaining means 28 in the slots 24, where they are retained until all slots 24 have been filled with one dowel 2 each.

In a preferred embodiment, it is provided that the line conveyor device 40 consists of at least two twin chains 56, 58; 60, 62, guided in parallel spaced from each other.

Figure 5:
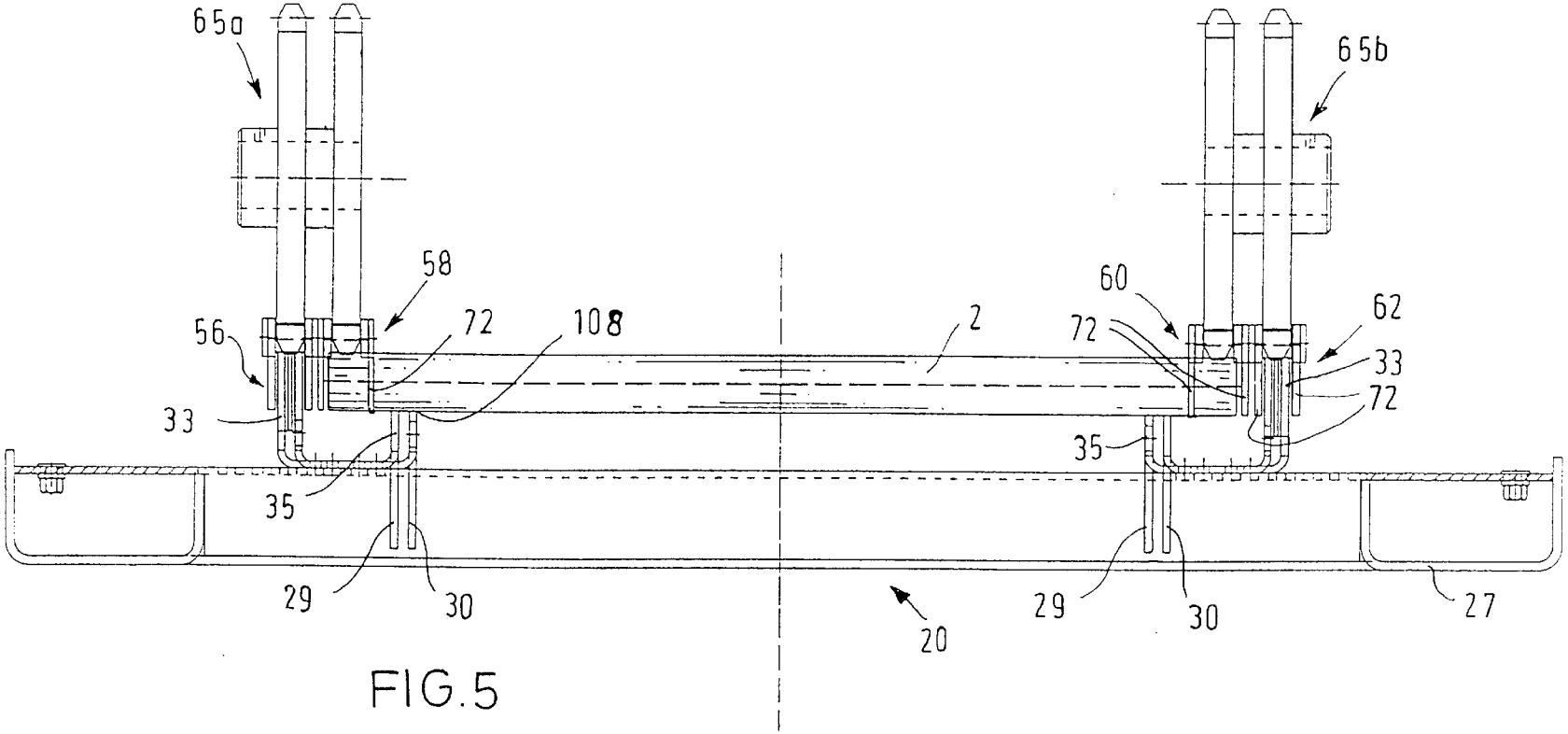
FIG. 5 is a lateral view of a portion of the smoothing board.

The distance between the conveyor chains is adapted to the length of the dowels 2, as is best seen in FIG. 5. The distance between the chain wheels 65*a*, 65*b* and all other chain wheels of the line conveyor device 40 is adjustable along the associated axes or the shaft 41 so as to easily adapt the line conveyor device 40 to different lengths of dowels 2.

As is best seen in FIG. 5, the free ends of the dowels 2 are received in pockets 70 by the inner twin chains 58, 60 that serve as conveyor chains, whereas the outer twin chains 5, 62 provide for the guiding of the dowels 2 in the longitudinal direction. Guide rails 35 for the twin chains 56, 58, 60, 62 are provided at the axial ends of the dowels 2. The guide rails with their substantially U-shaped cross section comprise inner side plates 29, 30 projecting orthogonally upward from a plate 37 parallel to the bottom, as well as an outer side plate 33, 38. The side plates 29, 30 support the dowels 2 on a sliding surface 108, whereas the outer side plates 33, 38 support the outer twin chains 56, 62.

Figure 10:
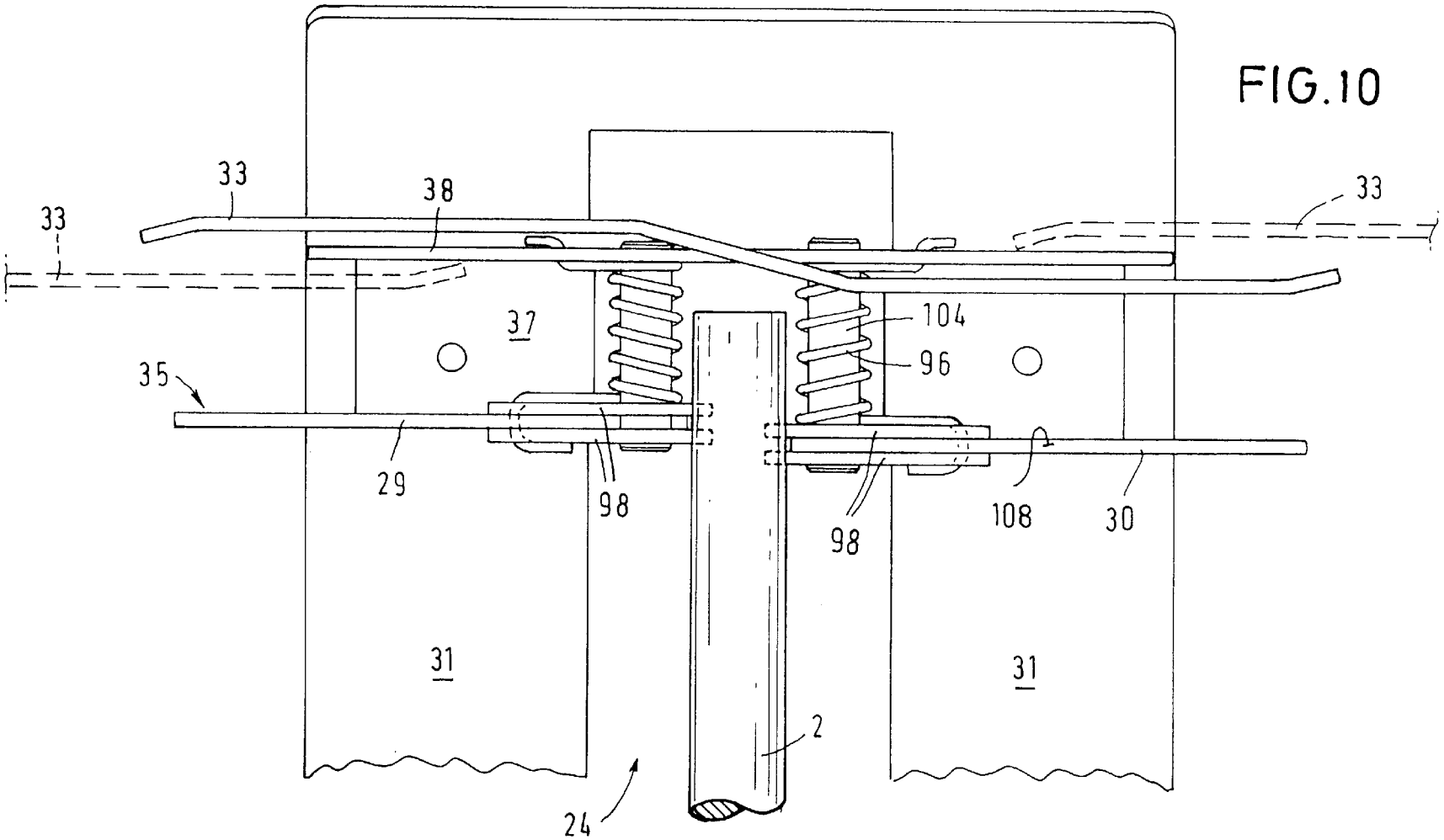
FIG. 10 is a top plan view on the embodiment of FIG. 8.

The inner side plates 29, 30 are spaced from each other in the transporting direction of the twin chains 56, 58, 60, 62, so as to leave a gap 39 through which the dowel 2 can fall into the slot 24. The gap 39 is delimited by plate portions of the side plates 29, 30 that extend downward beyond the plate 37. As is shown in FIG. 10, guide rails 35, adjacent in the transporting direction of the twin chains, can overlap each other. To this effect, the side plates 29, 30 extend on mutually offset planes. The outer side plate 23, which may be integral with the outer side plate 38 or which is fastened thereto, extends in two mutually offset planes, so as to allow for a nesting of adjacent guide rails 35.

To support the conveyor chains 56, 58, 60, 62 of the line conveyor device 40, an additional chain conveyor device 18 with a continuous twin chain 19 is provided in the vicinity of the storage containers 10, 12, the chain running synchronously with the twin chains 56, 58, 60, 62 and in the same direction. The twin chain 19 runs around the chain wheels 21, 22, 23 that are arranged in the middle between the chain wheels 63*a*, 63*b*, 64*a*, 64*b* so that the twin chain 19 extends centrally and in parallel between the twin chains 58, 60 and 60, 62.

The twin chains 56, 58, 60, 62 of the line conveyor device 40 may be tensioned using three idler chain wheels 67, 68, 69, wherein the axis of the idler chain wheel 68 can be locked vertically at different positions to adjust different widths of the machine without having to change the length of the twin chains. This is the case, for example, when the smoothing board 20 is extended or shortened by one or several board elements 27. FIG. 1 illustrates two alternative positions of the idler chain wheels 68.

Figure 3:
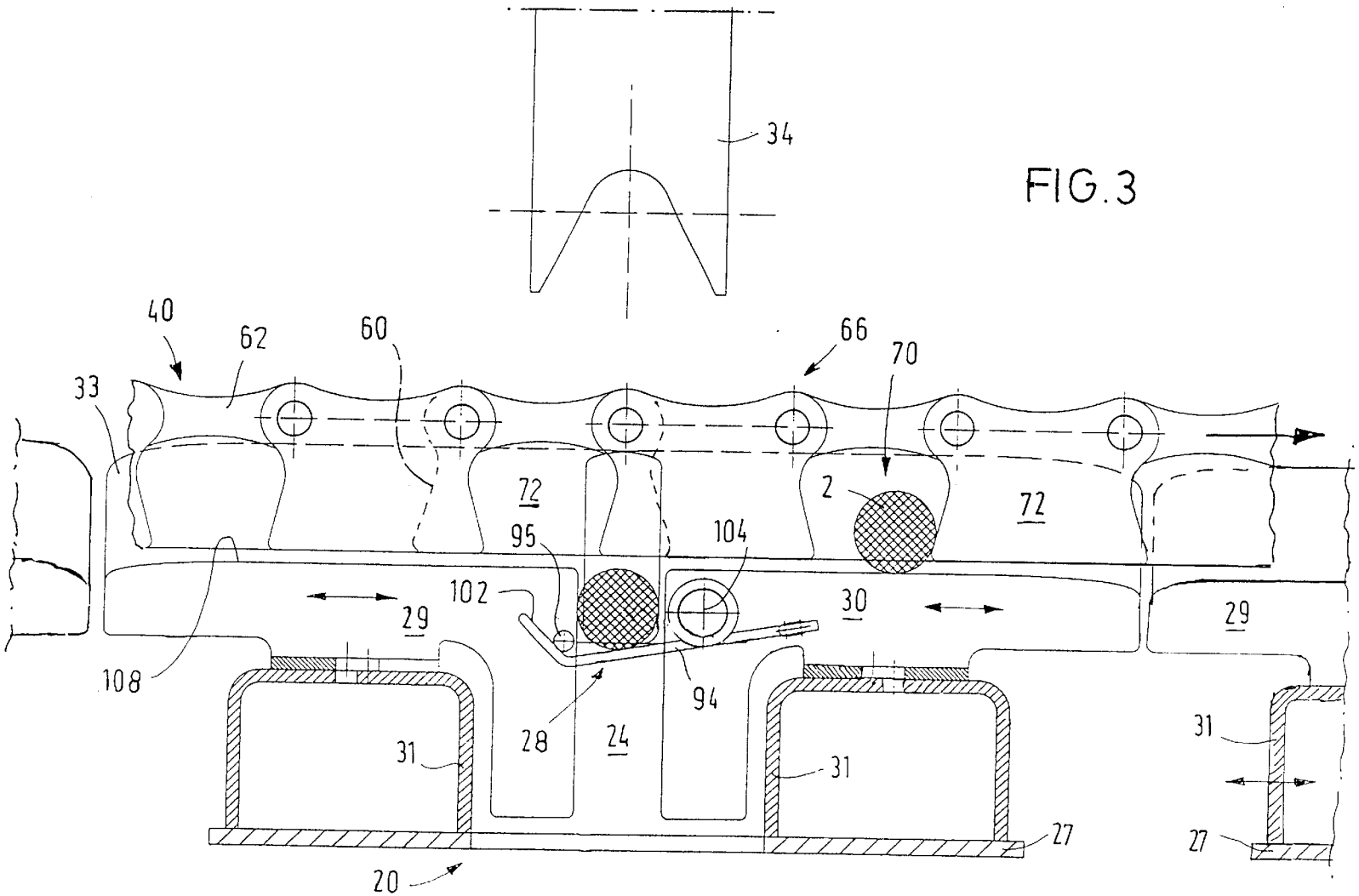
FIG. 3 is an enlarged view of the slot area in FIG. 1.

The shape of the chain links is best illustrated in FIG. 3. Every second chain link 66 has a guide metal sheet 72 on both sides of the chain, which extends outward from the chain link 66 substantially flaring in a trapezoid-like manner. The guide metal sheets 72 thus have an undercut tooth-shape and form a pocket 70 between every second chain link 66 for receiving the dowels 2, in which the dowels 2 are held securely even under vertical orientation of the conveyor chains.

The twin chains are disposed such that the guide metal sheets 72 of the outer conveyor chains 56, 62 cover the pockets 70 of the inner conveyor chains 58, 60 so that the dowels 2 are held in their longitudinal direction by the guide metal sheets 72 of the outer conveyor chains 56, 62. Preferably, the twin chains 56, 58 and 60, 62 are coupled through a common bolt.

FIG. 3 explains how the line conveyor device 40 transfers the dowels 2 into the slots 24 of the smoothing board. In FIG. 3, the conveyor chains of the line conveyor device 40 run to the right. When a vertically downward open pocket is located above a free slot 24, the dowel can fall into the slot 24 and is retained in the slot 24 by a retaining means 28 consisting of a spring element 94 pivotally movable about a receiving pin 104 such that the upper edge of the dowel 2 does not project beyond the sliding surface 108 on which the conveyor chains slide.

The width of the slots is adjustable to accommodate different dowel diameters by changing the position of the side plates 29, 30 on the board element 27 of the smoothing board 20. When changing the width of the slot 24, the retaining means 28 is also displaced since widening the slots causes the spring element 94 to be pivoted through a control cam 95 of a control surface 102 fastened to the side plate 29. The spring element 94 is supported for pivotal movement about a receiving pin 104 on the side plate 30. The free end of the spring element 94 is fastened on the side plate 30. When the slot width is changed, the spring element 94 is displaced downward so that a dowel of a larger diameter will not protrude beyond the sliding surface 108 even when the slot width is increased. Besides increasing the slot width, the distance between the slots 24 can be increased by displacing adjacent board elements 27.

Figure 8:
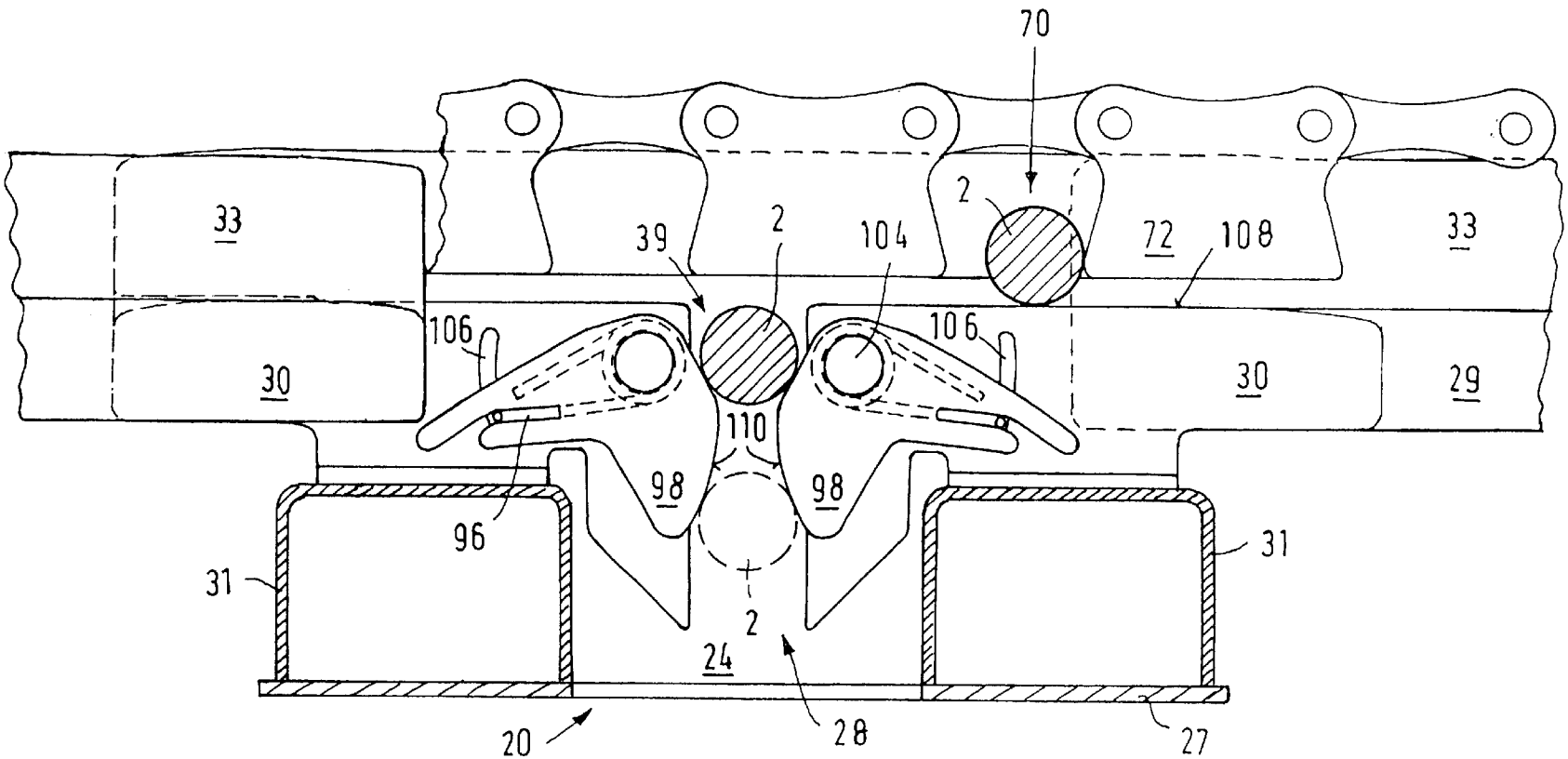
FIGS. 8 and 9 is an illustration corresponding to FIG. 3, showing an alternative embodiment of the slots.
Figure 9:
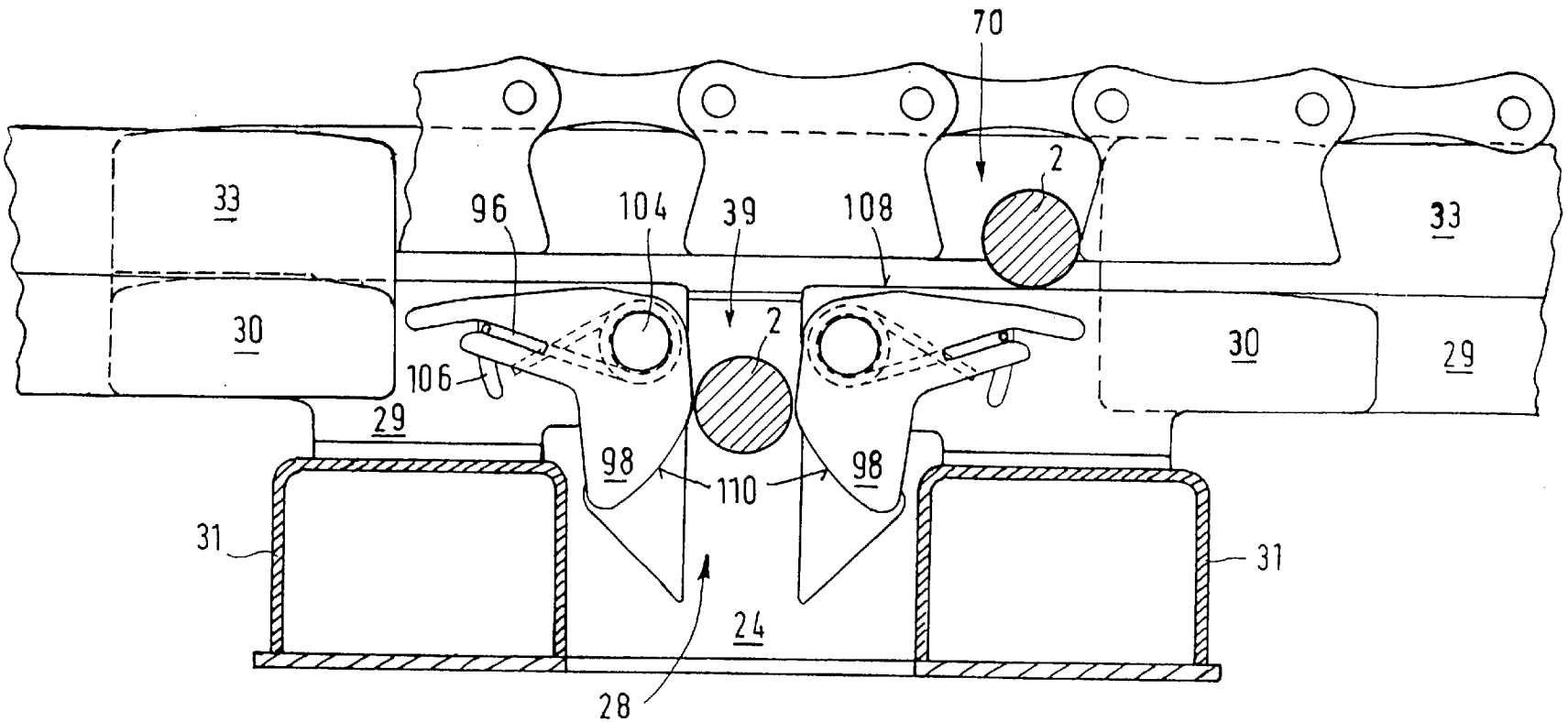

FIGS. 8 to 10 show an alternative embodiment of the retaining means 28 for the dowels 2. The retaining means 28 comprises at least two cam discs 98 arranged opposite and orthogonally relative to the dowel 2, which discs are pivotable about receiving pins 104 and receive and hold the dowel 2 between them inn a spring-loaded start position. As is best seen in FIG. 10, the cam discs 98 may be provided on both sides of the side plates 29, 30. The receiving pins 104 are supported both in the side plates 29, 30 of the sectionally U-shaped guide rail 35 and in the outer side plate 38 parallel to the inner side plates 29, 30. A spring element 96 is wound around the receiving pins 104 and biases the cam discs 98 towards the start position so that the opposite cam discs 98 hold the dowel 2 by its axial ends in the start position illustrated in FIG. 8. When pressure is exerted on the dowel 2, the cam discs 98 pivot against the force of the spring element 96 and release the dowel into the slot 96.

The forks 34 of the dowel placing means 32 grip the dowels 2 near their ends and press them out from the slot 24 into the road surface 4 against the force of the spring elements 94 or 96.The distance between the board portions 31 of the board elements 27 is selected such that the forks 34 can be passed between the board portions 31.

FIG. 9 illustrates a position in which the dowel 2 is pressed downward by the fork 34 into the slot 24, whereby the cam discs 98 are pivoted outward and downward relative to the dowel 2. In FIG. 9, the forks 34 are not illustrated for simplicity.

The cam discs have a control face 110 that supports itself on the dowel 2 when the dowel passes through and which prevents the cam discs 98 to suddenly return to their start position after having released the dowel 2. The return movement of the cam discs 98 is thus slowed down so that the impact load on the spring elements 96 is reduced.

Figure 2:
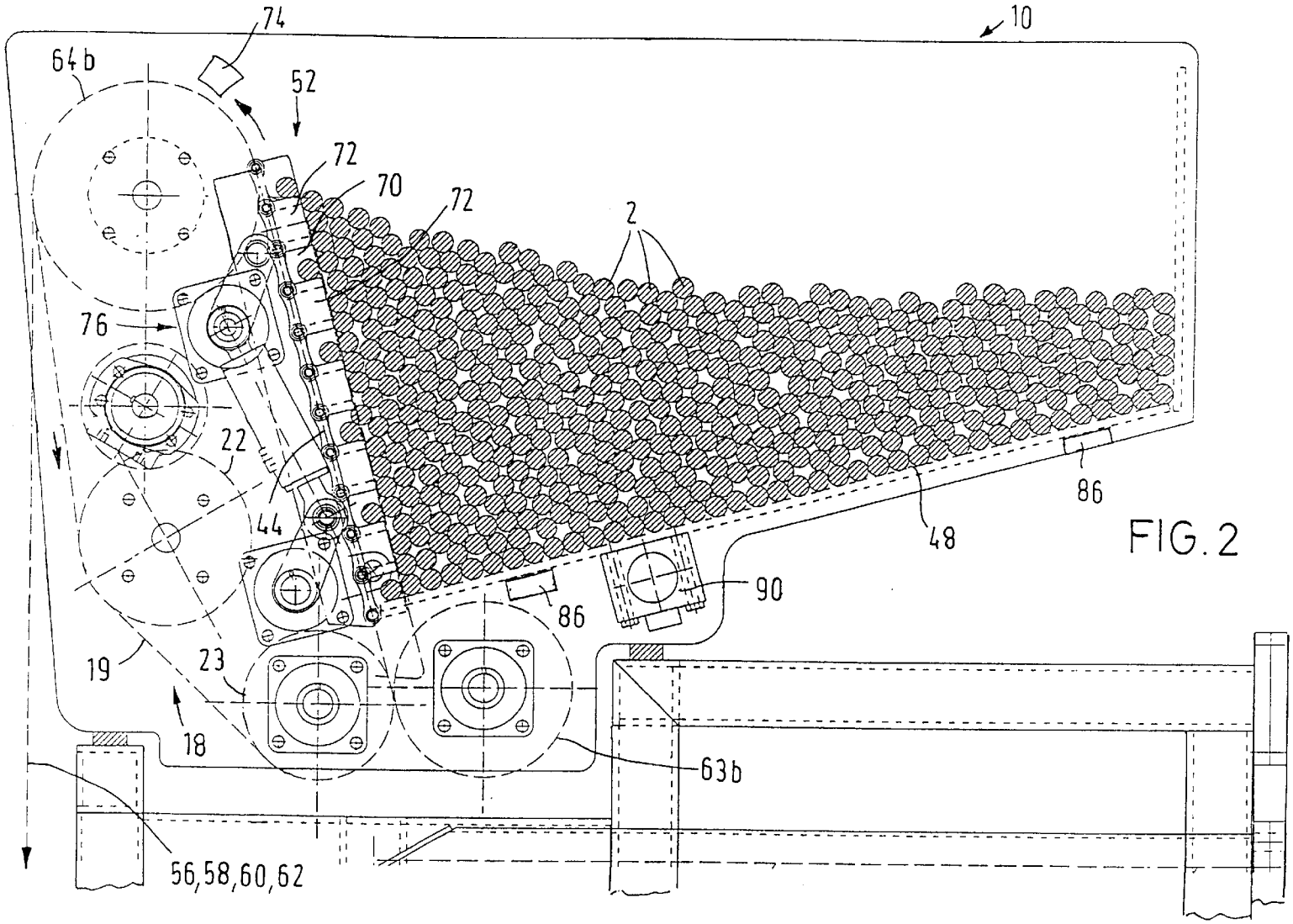
FIG. 2 is an enlarged view of the storage container area in FIG. 1.
Figure 4:
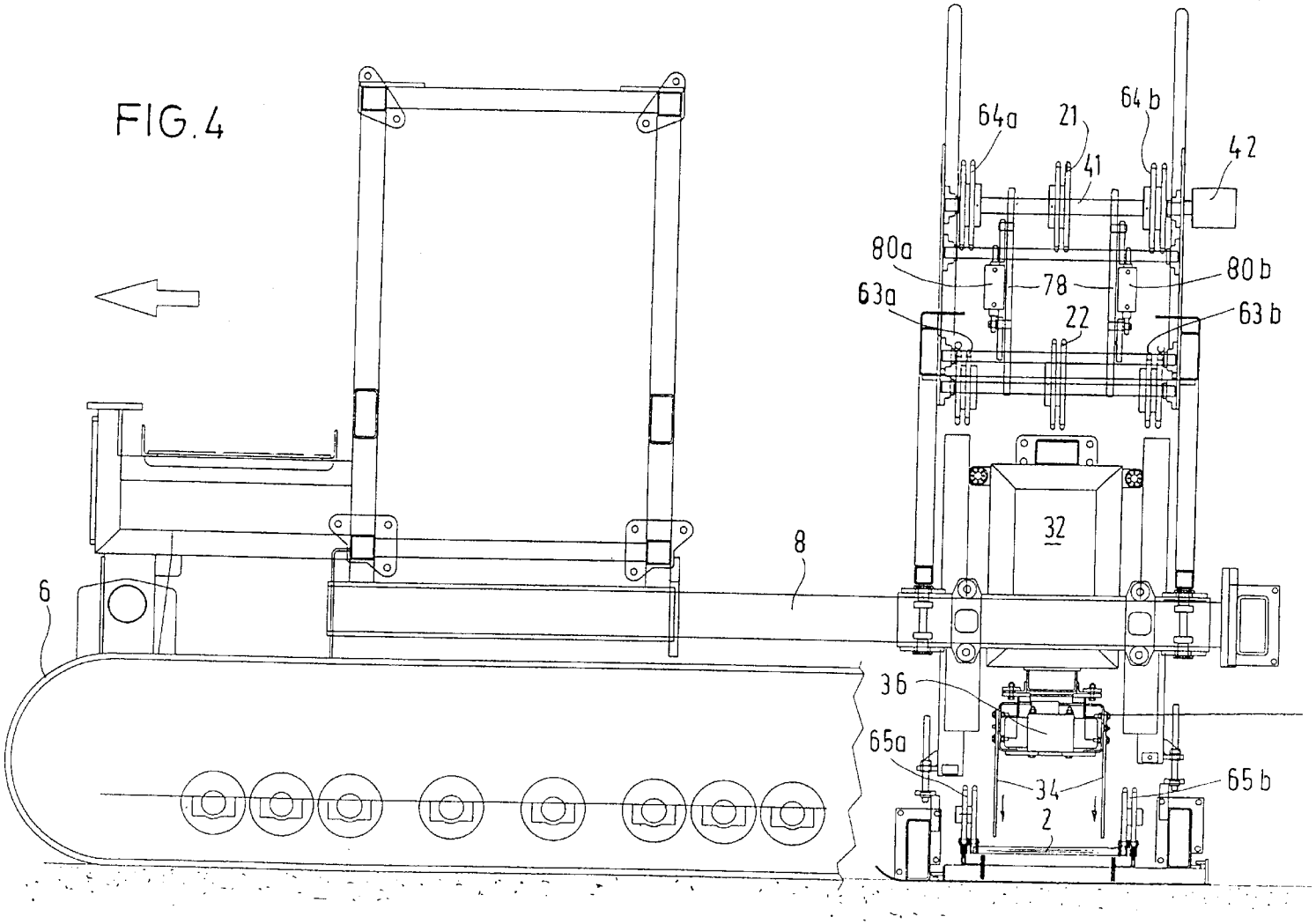
FIG. 4 is a lateral view of the dowel placing means.

FIG. 2 illustrates the storage container 10 on an enlarged scale. The line conveyor device 40 with the conveyor chains 56, 58, 60, 62, as well as the chain conveyor means 18 with the conveyor chain 19 are guided from bottom to top in the side portion 52 of the storage container in a linear section 44, with dowels 2 falling into the pockets 70 between the guide metal sheets 72 of the inner conveyor chains 58, 60 and the conveyor chain 19. The guide sheets 72 hold back the other dowels 2 in the storage container 10, 12. The outer conveyor chains 56, 62 guide the dowels 2 laterally, with guide plates possibly being provided within the storage container 10, 12 that guide the dowels 2 in their lateral orientation such that they can be received between the guide sheets 72 of the outer conveyor chains. At the upper end of the storage container, preferably in area of the chain wheels 64, a counting means 74 may be provided that counts the dowels 2 transported by the line conveyor means 40 and transmits a corresponding count signal to a control. When a sufficient number of dowels 2 has been received, a release device 76 is actuated that comprises two parallelogram-guided release plates 78*a*, 78*b*, two parallel links 79*a*, 79*b* and a respective piston cylinder unit 80*a*, 80*b*. The release plates or bars 78*a*, 78*b* extend, as is best seen in FIG. 4, between the conveyor chain 19 of the chain conveyor device 18 and the conveyor chains 56, 58, 60, 62 of the line conveyor device 40.

Figure 6:
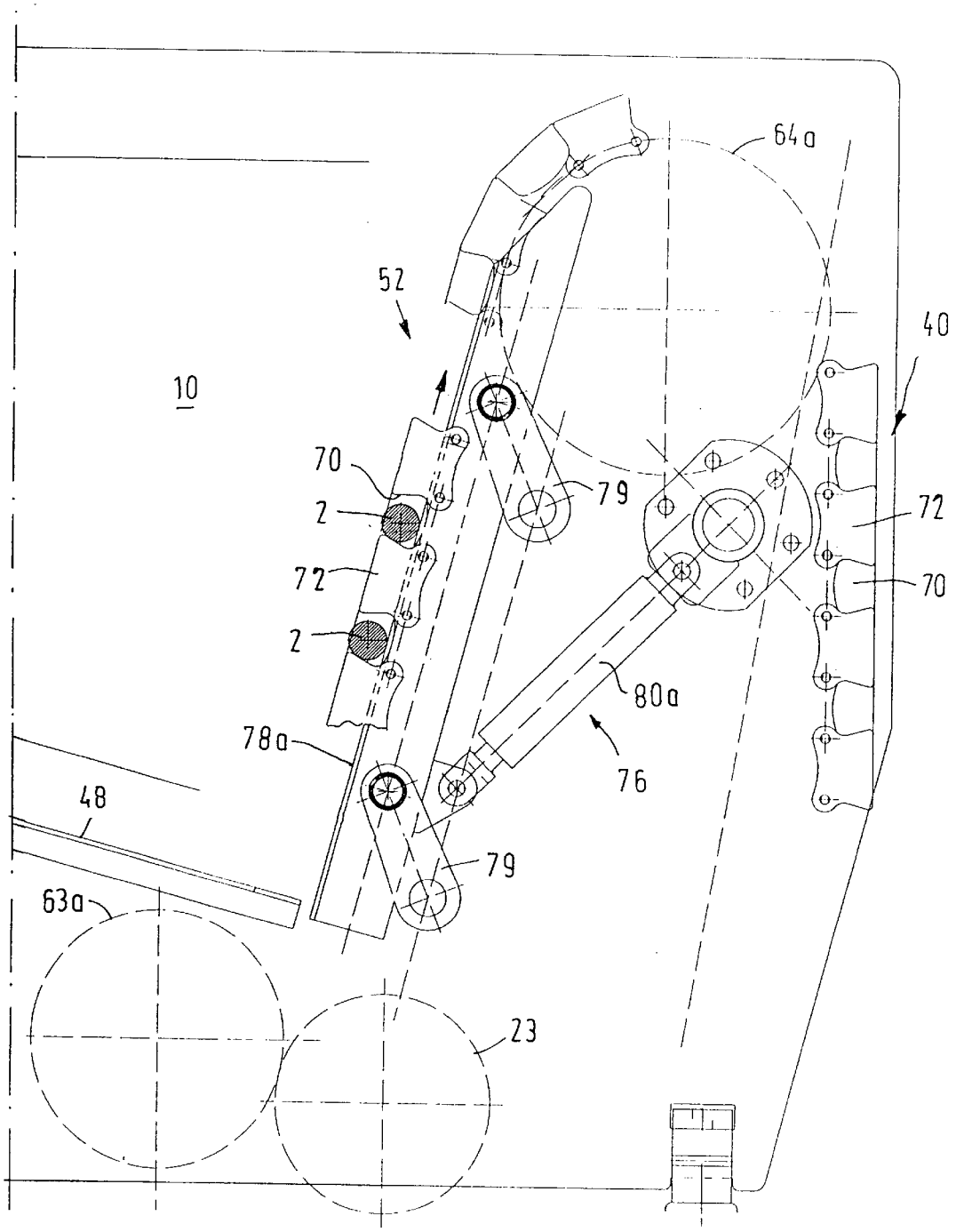
FIG. 6 is a schematic illustration of the release means for dowels in a passive state.
Figure 7:
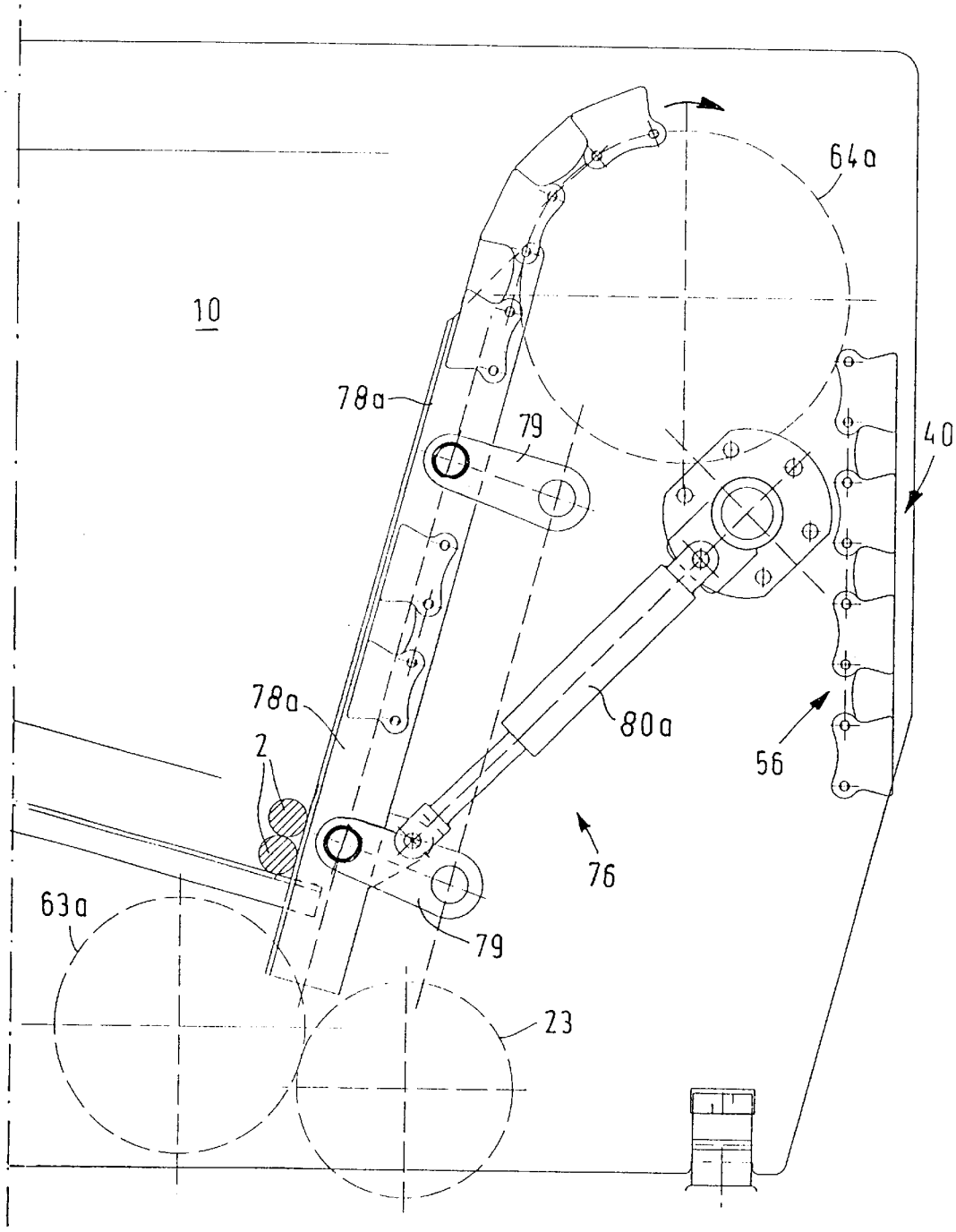
FIG. 7 is a schematic illustration of the release means for dowels in an activated state.

FIG. 6 illustrates the release device 76 in the inactive state, wherein the line conveyor device 40 and the chain conveyor device 18 takes individual dowels 2 in the pockets 70 between the guide sheets 72 from the storage container 10, 12, while FIG. 7 illustrates how the release plates 78*a*, 78*b* disengage the dowels 2 from the line conveyor device 40 and the chain conveyor device 18 by pushing the dowels 2 back into the storage container 10, 12.

As an alternative, the release plates or rods 78*a*, 78*b* may also disengage the dowels 2 by a pivotal movement.

The bottom wall 48 of the storage container 10, 12 may be supported at the storage container 10, 12 by elastic buffer elements 86. Further, a vibratory means 90 may be disposed on the bottom wall 48 so as to assist the advancing of the dowels 2 within the storage container 10, 12.

For clarity, FIG. 4 does not illustrate the conveyor chains. The chain wheels 64*a*, 21 and 64*b* are mounted for rotation with a shaft 41 and are driven by a hydraulic motor 42. Through the shaft 41, the conveyor chains of the line conveyor device 40 and the conveyor chain 19 of the chain conveyor device 18 are driven. The chain wheels 64*a*, 64*b* are displaceable in the axial direction of the shaft 41 and may be locked in different positions. The same is true for all other chain wheels and idler chain wheels of the line conveyor device 40, whereby an adaptation to different dowel lengths is possible.

Although a preferred embodiment of the invention has been specifically illustrated and described herein, it is to be understood that minor variations may be made in the apparatus without departing from the spirit and scope of the invention, as defined by the appended claims.

What is claimed is:

1. A device for inserting dowels (2) in the vicinity of transverse expansion joints of freshly laid concrete road surfaces (4), comprising a machine frame (8) supported by traveling mechanisms (6), at least one storage container (10,12) for the-dowels (2), a smoothing board (20) resting on the road surface (4) and including slots (24) running in a direction of travel and provided for accommodating the dowels (2), a retaining device (28) for the dowels associated with each of the slots (24), a continuous line conveyor device (40) disposed in transverse spanning relationship to the direction of travel and in alignment with a discharge area of said at least one storage container (10, 12), said conveyor device (40) including means (70) for directly receiving dowels (2) from an indiscriminately arranged stack of side-by-side dowels at said storage chamber discharge area along a first run portion of said conveyor device (40) and distributing said dowels (2) to the slots (24) along a second run portion of said conveyor device (40), said conveyor device second run portion extending above said slots (24), and means (34) movable through a plane defined by the conveyor device second run portion for pushing dowels (2) into a freshly laid concrete road surface.

2. The device according to claim 1, characterized in that the line conveyor device (40) comprises at least two conveyor chains (56,58,60,62) guided in parallel at a mutual distance.

3. The device according to claim 1, characterized in that the line conveyor device (40) comprises endlessly circulating elements.

4. The device according to claim 2, characterized in that the conveyor chains (56,58,60,62) of the line conveyor device (40) have arranged therebetween a chain conveyor device (18) comprising at least one endless chain (19) running synchronously with the line conveyor device (40) in the same running direction.

5. The device according to claim 1, characterized in that both sides of the machine frame (8) have arranged thereon one of said at least one storage container (10,12) for dowels (2) and that the running direction of the line conveyor device (40) can be switched.

6. The device according to claim 1, characterized in that the bottom area (48) and/or the lateral area (52) of the at least one storage container (10,12) extend obliquely to the road surface (4).

7. The device according to claim 2, characterized in that the chain links (66) of the line conveyor device (40) and the chain conveyor device (18) are provided with guide sheets (72) forming pockets (70) for receiving dowels (2) therebetween.

8. The device according to claim 1, characterized in that a counting device (74) counts the number of the dowels (2) accommodated by the line conveyor device (40) and transmits a count signals to a control device for the line conveyor device (40).

9. The device according to claim 8, characterized in that, in dependence on a signal from the control device, a release device (76) on the line conveyor device (40) pushes the dowels (2) out of an access region of the line conveyor device (40) back into the storage container (10,12) and moves the dowels (2) out of engagement with the line conveyor device (40).

10. The device according to claim 9, characterized in that the release device (76) comprises two release plates (78*a*, 78*b*) arranged for parallel displacement.

11. The device according to claim 9, characterized in that the release device (76) comprises release plates (78*a*,78*b*) supported to be pivoted on the storage container (10,12).

12. The device according to claim 1, characterized in that the line conveyor device (40) is provided with a device for removing excess dowels (2) and replacing missing dowels (2), respectively.

13. The device according to claim 1, characterized in that the bottom wall (48) of the at least one storage container (10,12) is supported on elastic buffer elements (86) and comprises at least one vibration means (90).

14. The device according to claim 1, characterized in that a retaining devices (28) on the slots (24) are arranged to release the dowels (2) upon pressurization by a dowel placing means (32).

15. The device according to claim 1, characterized in that the retaining devices (28) for the dowels (2) comprise spring elements (94;96) in the region of the slots (24).

16. The device according to claim 1, characterized in that the width of the slots (24) can be adapted to different dowel diameters and that, when changing the slot width, the position of the retaining devices (28) can be automatically changed such that the dowels (2) will not project upward beyond the slots (24).

17. The device according to claim 1, characterized in that the retaining devices (28) for the dowels (2) comprise two spring-loaded pivotable cam disks (98) arranged to receive and hold a dowel (2) therebetween in a starting position and to release the dowel (2) into the slot (24) upon pressurization of the dowel.

18. The device according to claim 17, characterized in that the cam disks (98) comprise a curved control face (110) and, after release of a dowel (2), perform a slowed movement into the starting position caused by the contact of the control face (110) with the downwardly moved dowel (2).

19. The device according to claim 1, characterized in that the working width of the line conveyor device (40) and the length of the slots (24) in the smoothing board (20) can be varied for adaptation to dowels (2) of different lengths.

20. The device according to claim 1, characterized in that the slots (24) have guide elements (33) arranged thereon for horizontal and vertical guidance of the line conveyor device (40).

21. The device according to claim 1, characterized in that the mutual distance of the slots (24) can be adjusted transversely to the moving direction.

22. The device according to claim 2, characterized in that the conveyor chains comprises twin chains (56,58,60,62).

23. The device according to claim 22, characterized in that the twin chains are arranged to laterally guide the dowels (2) by means of the guide sheets (72) of the outer conveyor chains (56,62).

24. The device according to claim 1, characterized in that the running direction of the line conveyor device (40) in the preferably linear section (44) of the storage container (10, 12) bottom or lateral area (48,52) arranged obliquely to the road surface (4), extends from below to above for take-over of the dowels (2).

25. The device according to claim 1, characterized in that the line conveyor device (40) is guided through the storage container (10,12) in a bottom or lateral area (48,52).

26. The device according to claim 1, characterized by being integrated into a slip form paver.

27. The device according to claim 2, characterized in that the line conveyor device (40) comprises endlessly circulating elements.

28. The device according to claim 3, characterized in that the conveyor chains (56,58,60,62) of the line conveyor device (40) have arranged therebetween a chain conveyor device (18) comprising at least one endless chain (19) running synchronously with the line conveyor device (40) in the same running direction.

29. The device as defined in claim 1 wherein said conveyor device first and second run portions are angularly related relative to each other.

30. The device as defined in claim 1 wherein said conveyor device first run portion substantially overlies and closes the discharge area of said storage container.

31. The device as defined in claim 29 wherein said conveyor device first run portion substantially overlies and closes the discharge area of said storage container.

32. The device as defined in claim 28 wherein the conveyor device first run portion substantially covers said discharge area.

33. The device as defined in claim 28 wherein the conveyor device first run portion substantially covers said discharge area and defines a wall of said at least one storage container.

34. The device as defined in claim 29 wherein the conveyor device first run portion substantially covers said discharge area.

35. The device as defined in claim 29 wherein the conveyor device first run portion substantially covers said discharge area and defines a wall of said at least one storage container.

* * * * *